US008596413B2

(12) United States Patent
Seib

(10) Patent No.: US 8,596,413 B2
(45) Date of Patent: Dec. 3, 2013

(54) ACOUSTIC ARRAY OF POLYMER MATERIAL

(75) Inventor: David C. Seib, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 13/544,352

(22) Filed: Jul. 9, 2012

(65) Prior Publication Data

US 2013/0025967 A1 Jan. 31, 2013

Related U.S. Application Data

(60) Provisional application No. 61/511,141, filed on Jul. 25, 2011.

(51) Int. Cl.
*E04B 1/82* (2006.01)

(52) U.S. Cl.
USPC ..... 181/292

(58) Field of Classification Search
USPC ..... 181/292
See application file for complete search history.

(56) References Cited

U.S. PATENT DOCUMENTS

| | | | | |
|---|---|---|---|---|
| 4,265,955 | A * | 5/1981 | Harp et al. | 428/116 |
| 5,490,602 | A * | 2/1996 | Wilson et al. | 216/56 |
| 6,601,672 | B2 * | 8/2003 | Liu | 181/290 |
| 7,967,108 | B2 * | 6/2011 | Harper | 181/292 |
| 2001/0017232 | A1 * | 8/2001 | Hogeboom et al. | 181/286 |
| 2011/0049300 | A1 * | 3/2011 | Safai et al. | 244/134 D |

* cited by examiner

*Primary Examiner* — Forrest M Phillips
(74) *Attorney, Agent, or Firm* — Edmonds & Nolte, PC

(57) ABSTRACT

The invention is an acoustic liner for attenuating noise in rotating machinery. The acoustic liner may include a plurality of cells coupled together to form an annular cell matrix, the plurality of cells being made of a non-metallic material, for example, plastics, polymers, thermoplastics, or thermosets. Each cell of the acoustic liner may be hexagonally-shaped such that the annular cell matrix forms a honeycomb structure.

18 Claims, 3 Drawing Sheets

ACOUSTIC ARRAY OF POLYMER MATERIAL

This application claims priority to U.S. Patent Application Ser. No. 61/511,141, which was filed Jul. 25, 2011. The priority application is hereby incorporated by reference in its entirety into the present application.

BACKGROUND

Rotating machinery, such as centrifugal compressors, is widely used in different industries for a variety of applications involving the compression of a gas. A typical compressor, however, generates a significant amount of noise which is an obvious nuisance to those in the vicinity of the device. This noise generated can also cause vibrations in the compressor which can lead to inefficiencies and even structural failure.

The dominant noise source in a centrifugal compressor is typically generated at the impeller exit or diffuser inlet, due to the high velocity of the fluid passing through these regions. The noise level becomes higher when discharge vanes are installed in the diffuser to improve pressure recovery, due to the aerodynamic interaction between the impeller and the diffuser vanes.

Various external noise control measures such as enclosures and wrappings have been used to reduce the noise generated by compressors and other rotating machinery. These external noise reduction techniques, however, can be relatively expensive, especially when offered as an add-on product after the device is manufactured. Internal noise control devices, usually in the form of acoustic liners, have also been used for controlling noise inside the gas flow paths of compressors and other rotating machinery. Some liners are based on Helmholtz resonators and include a three-piece sandwich structure consisting of honeycomb cells sandwiched between a perforated facing sheet and back plate. Although these three-piece designs efficiently suppress noise in aircraft engines, their performance declines in rotating machinery, such as centrifugal compressors. For example, the perforated facing sheet can break off its bond with the honeycomb under extreme operating conditions and thereby cause increased aerodynamic losses, and even the possibility of mechanical, catastrophic failure.

Other internal acoustic liners include steel, annular plates having a plurality of holes formed therein to provide an array of resonators, and an array of cavities defined beneath the holes to capture and cancel the sound waves. While these acoustic liners successfully overcome the drawbacks to conventional Helmholtz resonators, they also present various drawbacks. For instance, the holes and cavities of the acoustic liners are drilled into the metal base plates in a labor intensive and costly process which requires long periods of machining time and frequent tooling rehabilitation and/or replacement. Also, because the acoustic liners are made of metal, extensive manufacturing processes are required to create unique and diverse structural arrays to fit varying applications.

What is needed, therefore, is an internal acoustic liner system and method that reduces or eliminates the various drawbacks described above of current acoustic liners.

SUMMARY

Embodiments of the disclosure may provide a rotating machine. The rotating machine includes a casing defining a cavity and having an impeller arranged for rotation within the cavity, the cavity being fluidly coupled to an inlet conduit and a diffuser channel. The rotating machine further includes a first acoustic liner made at least partially of a non-metallic material and mounted to a metal diffuser wall defined in the diffuser channel to attenuate noise, the first acoustic liner being annular and having a first plurality of cells tightly-coupled together to form a first cell matrix.

Embodiments of the disclosure may further provide an acoustic liner for noise attenuation in rotating machinery, the acoustic liner comprising a plurality of cells coupled together to form an annular cell matrix, the plurality of cells being made of a non-metallic material.

Embodiments of the disclosure may further provide a method for attenuating noise in a rotating machine. The method may include arranging a first acoustic liner in a metal diffuser wall of the rotating machine, the first acoustic liner being annular and having a first plurality of cells tightly-coupled together to form a first cell matrix, the first acoustic liner being made of a non-metallic material. The method may further include dissipating noise emanating from a working fluid as the working fluid traverses the first acoustic liner.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
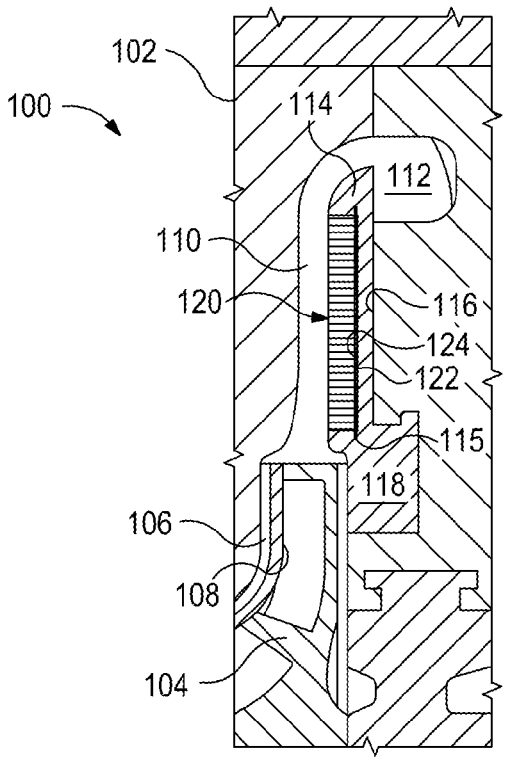
FIG. 1 illustrates a rotating machine with an exemplary acoustic liner arranged therein, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a portion of an exemplary rotating machine 100, according to one or more embodiments of the disclosure. In one embodiment, the rotating machine 100 may be a high-pressure fluid pressurizing device, such as a centrifugal compressor. The machine 100 may include a casing 102 in which an impeller 104 may be arranged for rotation. The impeller 104 may be arranged within an impeller cavity 106 defined in the casing 102. The impeller 104 may include openings 108, or flow passages, for increasing the velocity of a high-pressure working fluid flow. The casing 102 may also define a diffuser channel 110 arranged radially-outward from the impeller cavity 106 and the impeller 104. The diffuser channel 110 may be configured to receive the high-pressure working fluid from the impeller 104 and direct it to a volute 112, or collector, for discharge from the machine 100. While only one compression stage is shown in FIG. 1, it will be appreciated that the machine 100 may be a multi-stage compressor and include several compression stages axially-spaced from each other and configured to progressively compress the working fluid.

The machine 100 may also include a metal diffuser wall 114 that may, in at least one embodiment, be characterized as a mounting bracket 114 removably secured to an inner wall 116 of the diffuser channel 110. The mounting bracket 114 may partially define the diffuser channel 110 and include a base 118 disposed adjacent the impeller 104. An annular acoustic liner 120 may be mounted to the metal diffuser wall or bracket 114 in any known manner including, but not limited to, mechanically-fastening with bolts or adhesively bonding with an industrial-strength adhesive or the like. In other embodiments, the liner 120 may be inserted into a specially-designed channel 115 defined in the diffuser wall 114 and that allows for thermal expansion of the liner 120. In one embodiment, the acoustic liner 120 may be a one-piece, unitary plate-like structure, but in other embodiments the liner 120 may include two or more arcuate segments that form a complete plate-like annulus when placed end to end.

Figure 2:
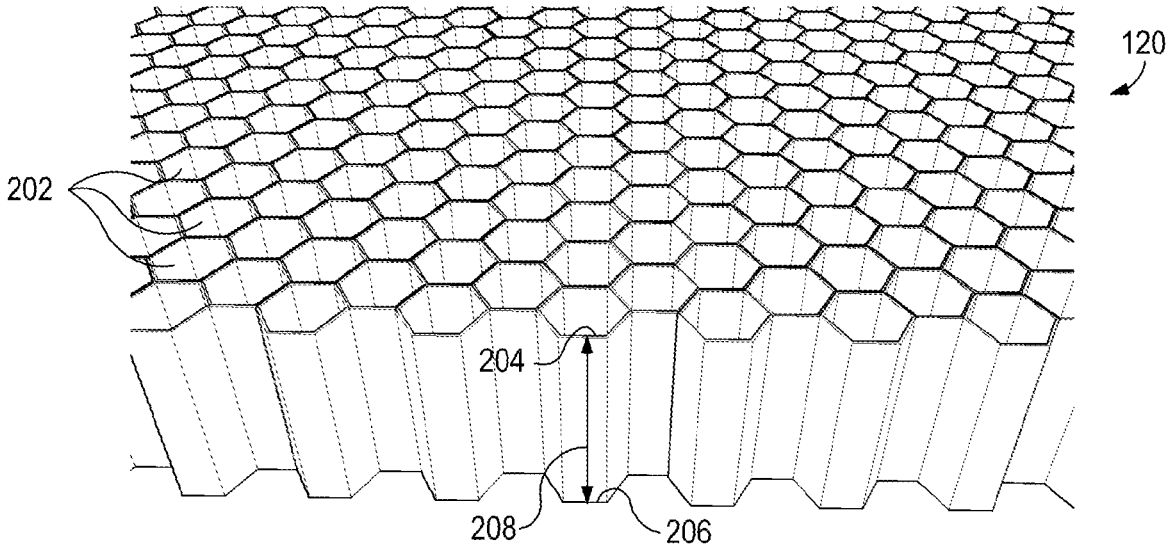
FIG. 2 illustrates a perspective view of an exemplary acoustic liner, according to one or more embodiments disclosed.

Referring to FIG. 2, illustrated is a portion of the acoustic liner 120, according to one or more embodiments. The liner 120 may define a plurality of cells 202, or openings, tightly-coupled together to form a cell matrix. Each cell may extend from a first end 204 to a second end 206, thereby providing or otherwise defining a cell depth 208. As illustrated, each cell 202 may be hexagonally-shaped such that the cell matrix forms a honeycomb structure made from numerous coupled cells 202. In other embodiments, however, the cells 202 may be formed in other polygonal shapes (e.g., octagonal, pentagonal, etc.) or may be generally circular.

The acoustic liner 120 is made of a non-metallic material, such as one or more plastics, polymers, thermoplastics, thermosets, combinations thereof, or the like. Suitable resins of the foregoing non-metallic materials can be or include resins containing nitrogen, oxygen, halogen, sulfur or other groups capable of interacting with one or more aromatic functional groups such as a halogen or acidic groups. In one or more embodiments, the acoustic liner 120 is made from resins including, but not limited to, polyamides, polyimides, polycarbonates, polyesters, polysulfones, polylactones, polyacetals, acrylonitrile-butadiene-styrene resins (ABS), polyphenyleneoxide (PPO), polyphenylene sulfide (PPS), polystyrene, styrene-acrylonitrile resins (SAN), styrene maleic anhydride resins (SMA), aromatic polyketones (PED and PEKK), polyetheretherketones (PEEK), epoxy, phenolic silicone, cyanoacrylates, anaerobics and acrylics, and mixtures thereof. Suitable thermoplastics and thermosets may include, but are not limited to, polythene, polyethersulphone, and polyvinylchloride (PVC). The non-metallic material may also include nylon, polytetraflouroethelene (PTFE), and epoxy resins cured by amines.

The acoustic liner 120 may be manufactured by forming (e.g., thermoforming) thin film sheets of the non-metallic material into an array of semi-hexagonal shapes (or other polygonal shapes discussed above). The formed sheets may be sequentially stacked and then welding together with, for example, a laser along lines at the contact points to achieve melt-bonding. In other embodiments, the sheets may be coupled together using adhesives, or the like.

Referring again to FIG. 1, in one embodiment the acoustic liner 120 includes a backing member 122 that may be juxtaposed against an inside surface 124 of the metal diffuser wall or mounting bracket 114 when installed in the machine 100. The backing member 122 may be joined to the cells 202 of the liner 120 by any suitable process such as, but not limited to, laser welding and/or adhesive bonding. In other embodiments, the backing member 122 may be entirely omitted from the acoustic liner 120 and the inside surface 124 of the metal diffuser wall or bracket 114 may serve the same purpose as the backing member 122. Due to the firm contact between the acoustic liner 120 and the backing member 122, or between the acoustic liner 120 and the inner wall 124 where the backing member 122 is omitted, the cells 202 of the liner 120 work collectively as a polymeric array of acoustic resonators. In operation, sound waves generated in the casing 102 by the rotation of the impeller 104, and/or by its associated components, are attenuated as they traverse the acoustic liner 120.

It will be appreciated that several variations in the size, shape, and depth 208 of the cells 202 are contemplated herein in order to tune the acoustic liner 120 and thereby attenuate predetermined or otherwise troublesome noise frequencies. For example, the dominant noise component commonly occurring at the blade passing frequency, or other high frequency, can be effectively lowered by tuning the acoustic liner 120 so that its maximum noise attenuation occurs at about the blade passing frequency. Tuning the liner 120 may be achieved by varying the volume of the cells 202 (e.g., by altering the cross-sectional area), the number of cells 202, and/or the depth 208 (FIG. 2) of the cells 202. Accordingly, a maximum amount of attenuation of the acoustic energy generated by the impeller 104 and its associated components can be derived.

Those skilled in the art will readily appreciate the several advantages provided by the non-metallic acoustic liner 120. For example, there is no inherent constraint on the size of the acoustic liner 120 that may be formed during the manufacturing process. Further, both flat and curved parts or portions may be manufactured with relative ease, such that significant monetary and time savings are realized by obviating the meticulous process of drilling numerous holes in a metal plate. The acoustic liner 120 disclosed herein also saves on material costs since polymers, plastics, and thermoplastics are generally less expensive than their completed metal counterparts, and any scraps or cuttings from the liner 120 may be recycled and used in the manufacture of additional liners 120 or other devices. The liner 120 also saves on machining time and tooling costs, since multiple holes are not required to be drilled and the tools used will therefore last longer and not require frequent and time-consuming rehabilitation and/or replacement. Accordingly, the non-metallic acoustic liner 120 satisfies a long-felt need in the field of rotating machinery and acoustic attenuation, since it is advantageous to locate and capitalize on any machine aspect that has the effect of reducing manufacturing/operating costs and increasing operating efficiency.

Figure 3:
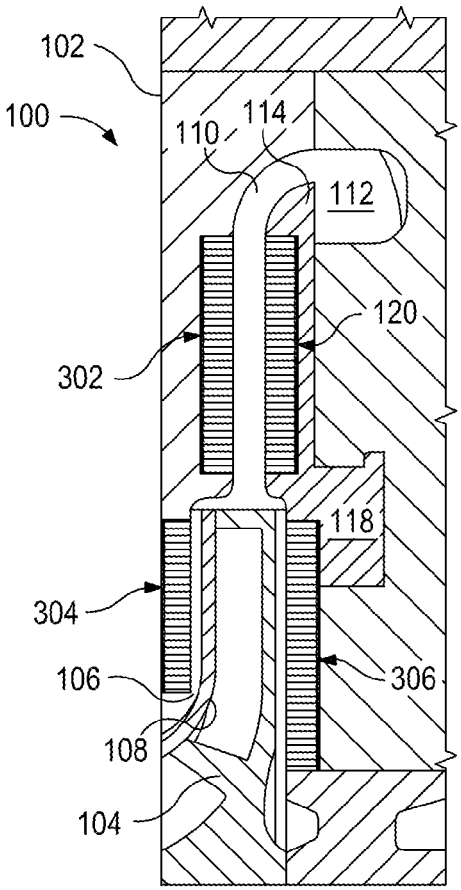
FIG. 3 illustrates a rotating machine with several exemplary acoustic liners arranged therein, according to one or more embodiments disclosed.

Referring now to FIG. 3, illustrated is another configuration of the rotating machine 100, according to one or more embodiments described. As illustrated, an additional or second acoustic liner 302 may be provided in the diffuser channel 110 of the casing 102 opposite the first acoustic liner 120 described above. To accommodate the second acoustic liner 302, a portion of the wall forming the diffuser channel 110 may be excised in order to receive and seat the second acoustic liner 302. The second acoustic liner 302 may be substantially comparable to the first acoustic liner 120 described above with reference to FIGS. 1 and 2 and therefore will not be described in detail. Moreover, the second liner 302 may function in a substantially similar manner as the first liner 120 as described above, and hence also attenuates the noise generated by the machine 102 and its associated components.

Also depicted in FIG. 3 are two additional acoustic liners, shown as third and fourth acoustic liners 304 and 306, respectively. The third and fourth acoustic liners 304, 306 may be located at other strategic noise-attenuating locations within the casing 102. For example, the additional liners 304, 306 may be arranged axially-adjacent the front end and the rear end of the impeller 104, respectively, and corresponding portions of the internal walls of the cavity 106 may be excised to accommodate these liners 304, 306. As with the second acoustic liner 302, the third and fourth acoustic liners 304, 306 may be substantially comparable with the first acoustic liner 120 described above, and therefore will not be described in detail.

Figure 4:
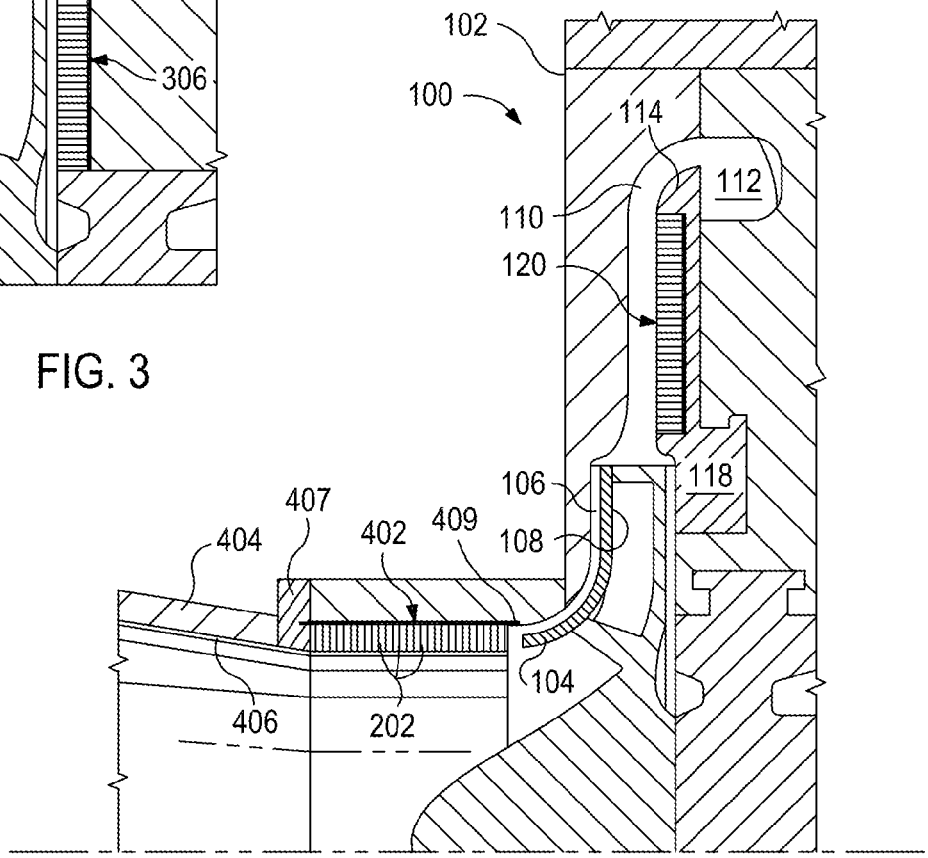
FIG. 4 illustrates a rotating machine with two exemplary acoustic liners arranged therein, according to one or more embodiments disclosed.

Referring to FIG. 4, illustrated is another exemplary configuration of the rotating machine 100, according to one or more embodiments disclosed. As illustrated, another strategic location where an additional, or fifth acoustic liner 402 may be located may be in an inlet conduit 404 configured to introduce the working fluid into the impeller 104. The fifth acoustic liner 402 may be made of the same non-metallic material(s) and function substantially similar to the first acoustic liner 120 described above with reference to FIGS. 1 and 2. In one embodiment, the fifth liner 402 may be a cylindrical component, in the general shape of a curved shell, and arranged in an excised portion of an inner surface 406 or wall of the inlet conduit 404. The liner 402 may be flush-mounted with the inner surface 406 of the inlet conduit 404, with the radial outer portion being shown.

The liner 402 may be attached to the conduit 404 in any known manner including, but not limited to, mechanically-fastening with bolts or adhesively-fastening with an industrial-strength adhesive or the like, or combinations thereof. In one embodiment, a bolt-on shoulder 407 is used to seat the liner 402. As with the liner 120 described above with reference to FIG. 1, the liner 402 may also be inserted into a specially-designed channel 409 that allows the liner 402 to thermally expand. Because the liner 402 is made of a non-metallic material, it may be molded or otherwise formed into a generally-cylindrical shape prior to being installed in the machine 100. In other embodiments, the liner 402 may include two or more arcuate, partial-cylindrical segments configured to be combined to form a complete annulus.

Figure 5:
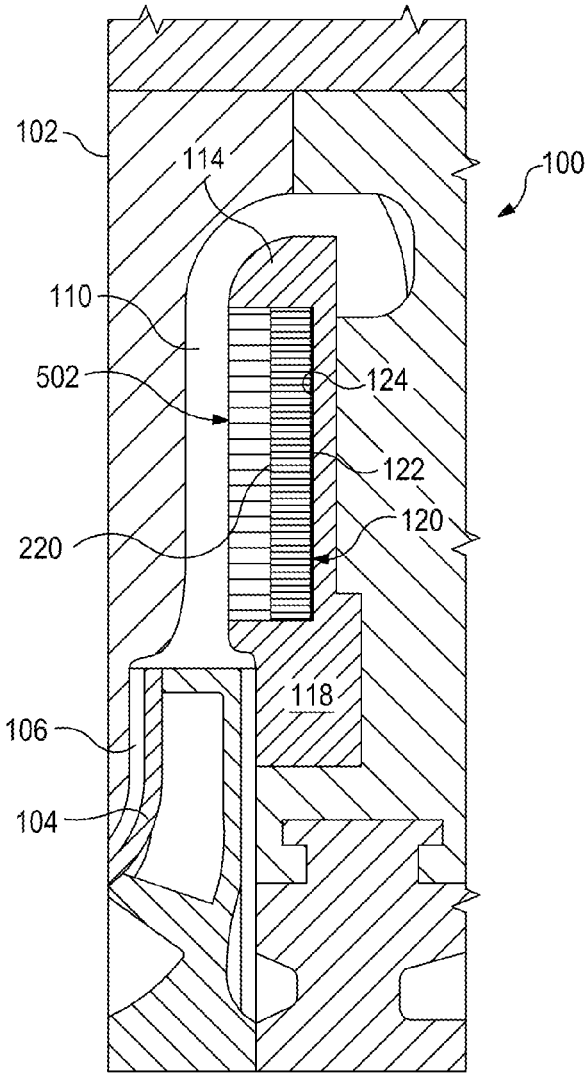
FIG. 5 illustrates a rotating machine with an exemplary acoustic liner arranged therein, according to one or more embodiments disclosed.

Referring now to FIG. 5, illustrated is another exemplary embodiment of the rotating machine 100 that may employ a combination of two juxtaposed or laterally-stacked acoustic liners 120 and 502 to attenuate noise. Specifically, the first acoustic liner 120, as described above with reference to FIGS. 1 and 2, is seated within the metal diffuser wall or bracket 114 and may or may not include the backing member 122 juxtaposed against the inner surface 124 of the bracket 114. Also, the backing member 122 may also be omitted, as described above, such that the first acoustic liner 120 contacts the inner surface 124 of the metal diffuser wall bracket 114 directly. A second acoustic liner 502 may also be arranged in an axially-abutting relationship with the first acoustic liner 120. The second acoustic line 502 may be substantially similar in structure and function as the first acoustic liner 120 and therefore will not be described in detail.

In their juxtaposed arrangement, the cells 202 of the first acoustic liner 120 may be in fluid communication with the cells 202 of the second acoustic liner 502, while the cells 202 of the second acoustic liner 502 are in fluid communication with the working fluid coursing through the diffuser 110. As illustrated, the cells 202 of the first acoustic liner 120 may be of a different size (e.g., cross section, depth 208 (FIG. 2), shape, volume, etc.) than the cells 220 of the second acoustic liner 502. Consequently, the acoustic liners 120, 502 work in concert to dissipate acoustic energy emanating from the machine 100 and its components. Differing sizes of cells 220 between the first and second liners 120, 502 may prove advantageous in further dissipating acoustic energy encountered in the machine 100. In other embodiments, however, the general sizes of the cells 202 in each liner 120, 502 may be reversed such that the cells 202 of the first liner 120 are larger than the cells 202 of the second liner 502, without departing from the scope of the disclosure. It will be appreciated that one or both of the acoustic liners 120, 502 may be made of the non-metallic materials described above, such as one or more plastics, polymers, thermoplastics, thermosets, combinations thereof, or the like.

Figure 6:
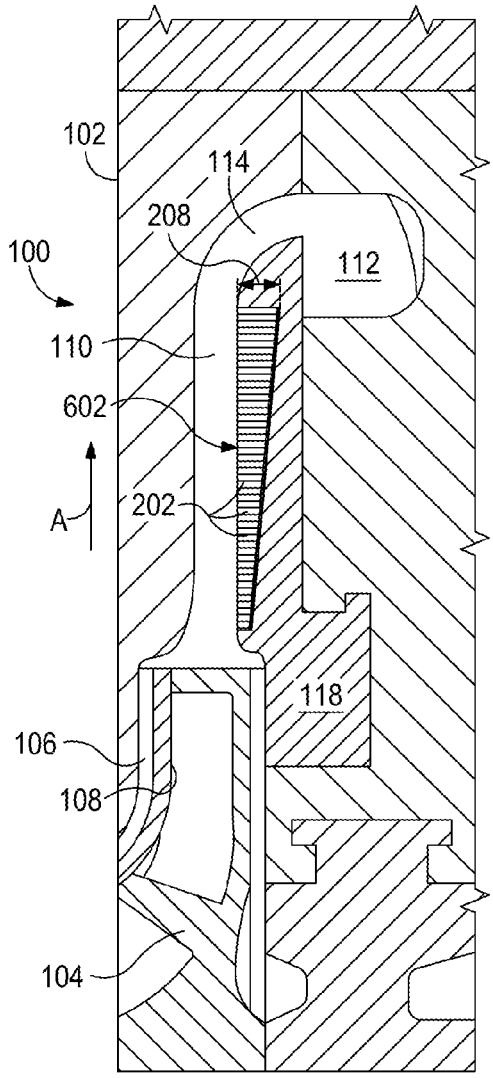
FIG. 6 illustrates a rotating machine with another exemplary acoustic liner arranged therein, according to one or more embodiments disclosed.

Referring now to FIG. 6, illustrated is yet another exemplary configuration of the rotating machine 100, according to one or more embodiments disclosed. The machine 100 may include an acoustic liner 602 having cells 202 of varying depth 208. Apart from the varying depth 208 of the cells 202, the acoustic liner 602 may be substantially similar in structure and function as the first acoustic liner 120 described above with reference to FIGS. 1 and 2, and therefore will not be described in detail. As illustrated, the relative depth 208 of the cells 202 with respect to each other may progressively increase in the radial direction, as indicated by the directional arrow A (e.g., the "radial-outward" direction). The varying depth 208 of the cells 202 may be configured to dissipate sound waves covering a larger span than what would otherwise be captured and dissipated by an acoustic liner having cells 202 of a uniform depth 208.

It will be appreciated that numerous variations of the acoustic liner 602 may be implemented without departing from the scope of the disclosure. For example, in at least one embodiment the relative depth 208 of the cells 202 with respect to each other may decrease in the radial direction A. In other embodiments, the acoustic liner 602 may be broken up into stepped, linear segments of cells 202 where each "step" of cells 202 has a different depth 208, such that the linear segments increase or decrease step-wise in depth 208 in the radial direction A.

Moreover, while a linear transition in the depth 208 of the cells 202 is shown in FIG. 6, other embodiments contemplated herein include a non-linear transition in the depth 208 of the cells 202, where the depth 208 of the cells 202 fluctuates in the radial direction A according to a mathematical function. The non-linear mathematical function may include, but is not limited to, a squared or square root function, an exponential function, a transcendental function such as a sine, cosine, or arc-cosine function, and a polynomial function such as a quadratic function. In yet other embodiments, a combination of linear and non-linear depths 208 of cells 202 may be implemented in a single acoustic liner 602.

It will further be appreciated that the size, shape, volume, depth 208, etc. of the cells 202 of any and/or all of the acoustic liners 120, 302, 304, 306, 402, 502, 602 described herein may be varied so as to target specific sound wave frequencies exhibited at the location of each liner 120, 302, 304, 306, 402, 502, 602 in the machine 100, thereby contributing to a significant reduction of the noise generated in the casing 102. Also, any and/or all of the acoustic liners 120, 302, 304, 306, 402, 502, 602 described herein may be able to be "doubled-up" with another acoustic liner, as generally described above with reference to the configuration shown in FIG. 5.

Lastly, it will be appreciated that the embodiments discussed herein may be equally applicable to other machinery, besides the rotating machinery 100 described herein. For example, it is equally contemplated to use one or more of the acoustic liners 120, 302, 304, 306, 402, 502, 602 described herein in reciprocating compressors or supersonic compressors. Depending on the polymeric composition, it is further contemplated to employ the acoustic liners 120, 302, 304, 306, 402, 502, 602 in high temperature applications, such as steam turbines, without departing from the scope of the disclosure.

Figure 7:
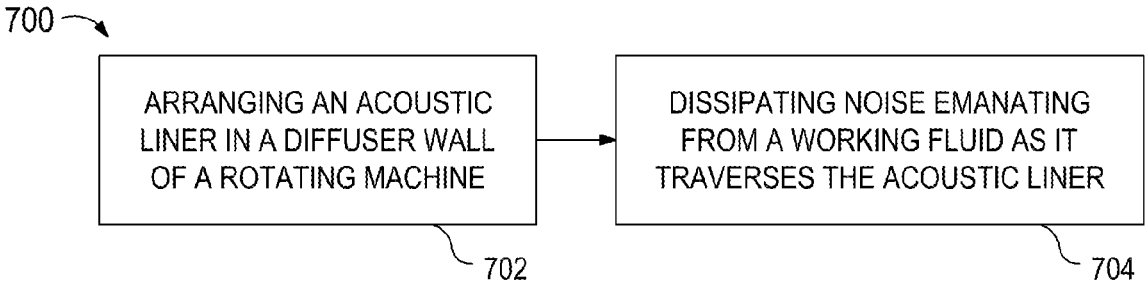
FIG. 7 illustrates a flowchart of a method of attenuating noise in a rotating machine, according to one or more embodiments disclosed.

Referring to FIG. 7, illustrated is a flowchart of a method 700 for attenuating noise in a rotating machine. In one embodiment, the method 700 may include arranging a first acoustic liner in a metal diffuser wall of the rotating machine, as at 702. The first acoustic liner may be annular and have a first plurality of cells tightly-coupled together to form a first cell matrix. Moreover, the first acoustic liner may be made of a non-metallic material, such as a polymer, plastic, thermoplastic, or thermoset. The method 700 may also include dissipating noise emanating from a working fluid as the working fluid traverses the first acoustic liner, as at 704.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A rotating machine, comprising:

a casing defining a cavity and having an impeller arranged for rotation within the cavity, the cavity being fluidly coupled to an inlet conduit and a diffuser channel;

a first acoustic liner mounted to a metal diffuser wall defined in the diffuser channel to attenuate noise, the first acoustic liner being annular and having a first plurality of cells tightly-coupled together to form a first cell matrix;

a second acoustic liner mounted to the metal diffuser wall opposite the first acoustic liner and adapted to attenuate noise, the second acoustic liner being annular and having a second plurality of cells tightly-coupled together to form a second cell matrix, and the first and second acoustic liners being at least partially non-metallic; and a backing member disposed between the first and second acoustic liners and the respective metal diffuser walls, wherein each cell of the first cell matrix and the second cell matrix is a single bore extending axially from the diffuser channel to the backing member, each cell of the first cell matrix and the second cell matrix defines a flowpath having a uniform cross-section from the diffuser channel to the backing member, and each cell of the first cell matrix and the second cell matrix has six or more sidewalls.

2. The rotating machine of claim 1, wherein each of the plurality of cells is hexagonally-shaped such that the first cell matrix forms a honeycomb structure.

3. The rotating machine of claim 1, wherein the first and second acoustic liners include one of a plastic, polymer, thermoplastic, or thermoset.

4. The rotating machine of claim 1, wherein the first and second acoustic liners include polyetheretherketone.

5. The rotating machine of claim 1, further comprising:

a third acoustic liner arranged axially-adjacent a front end of the impeller and disposed within a first excised portion of an internal cavity wall, the third acoustic liner being annular and having a third plurality of cells tightly-coupled together to form a third cell matrix; and a fourth acoustic liner arranged axially-adjacent a rear end of the impeller and disposed within a second excised portion of the internal cavity wall, the fourth acoustic liner being annular and having a fourth plurality of cells tightly-coupled together to form a fourth cell matrix, wherein the third and fourth acoustic liners are at least partially non-metallic.

6. The rotating machine of claim 1, further comprising:

a third acoustic liner arranged in the inlet conduit to attenuate noise, the third acoustic liner being cylindrical and having a third plurality of cells tightly-coupled together to form a third cell matrix, the third acoustic liner being at least partially non-metallic.

7. The rotating machine of claim 1, further comprising:

a third acoustic liner mounted to the metal diffuser wall juxtaposed with the first acoustic liner, the third acoustic liner being annular and having a third plurality of cells tightly-coupled together to form a third cell matrix, the third acoustic liner being at least partially non-metallic.

8. The rotating machine of claim 7, wherein the first plurality of cells are in fluid communication with the third plurality of cells, and the first plurality of cells are of a different size than the third plurality of cells.

9. The rotating machine of claim 1, wherein a relative depth of each of the first plurality of cells varies.

10. The rotating machine of claim 9, wherein the relative depth of each of the first plurality of cells at least one of progressively increases in a radial-outward direction and progressively decreases in a radial-outward direction.

11. An acoustic liner for noise attenuation in rotating machinery, the acoustic liner comprising a plurality of cells coupled together to form an annular cell matrix, the plurality of cells being made of a non-metallic material, wherein each cell of the plurality of cells has two ends axially separated from each other, a backing member being coupled to one of the two axially separated ends on a same side of the annular cell matrix, each cell of the plurality of cells is a single bore extending between the backing member and the other axial end, each cell of the plurality of cells defines a flowpath having a uniform cross-section from the other axial end to the backing member, and each cell of the plurality of cells has six or more sidewalls.

12. The acoustic liner of claim 11, wherein each cell of the plurality of cells is hexagonally-shaped such that the annular cell matrix forms a honeycomb structure.

13. The acoustic liner of claim 11, wherein the non-metallic material is a polymer.

14. The acoustic liner of claim 13, wherein the non-metallic material is polyetheretherketone.

15. The acoustic liner of claim 11, wherein a relative depth of each of the plurality of cells progressively increases or decreases in a radial-outward direction.

16. A method for attenuating noise in a rotating machine, comprising:

arranging a first acoustic liner in a metal diffuser wall of the rotating machine, the first acoustic liner being annular and having a first plurality of cells tightly-coupled together to form a first cell matrix;

arranging a second acoustic liner in the metal diffuser wall opposite the first acoustic liner, the second acoustic liner being annular and having a second plurality of cells tightly-coupled together to form a second cell matrix, and the first and second acoustic liners being at least partially non-metallic;

arranging a backing member between the first and second acoustic liners and the respective metal diffuser walls; and dissipating noise emanating from a working fluid as the working fluid traverses the first acoustic liner and the second acoustic liner, wherein each cell of the first cell matrix and the second cell matrix is a single bore extending axially from a diffuser channel of the rotating machine to the backing member, each cell of the first cell matrix and the second cell matrix defines a flowpath having a uniform cross-section from the diffuser channel to the backing member, and each cell of the first cell matrix and the second cell matrix has six or more sidewalls.

17. The method of claim 16, further comprising:

arranging a third acoustic liner in an inlet conduit of the rotating machine, the third acoustic liner being cylindrical and having a third plurality of cells tightly-coupled together to form a third cell matrix, and the third acoustic liner being at least partially non-metallic; and dissipating additional noise emanating from the working fluid as the working fluid traverses the third acoustic liner.

18. The method of claim 16, further comprising:

arranging a third acoustic liner axially-adjacent a front end of the impeller and disposed within a first excised portion of an internal cavity wall;

arranging a fourth acoustic liner axially-adjacent a rear end of the impeller and disposed within a second excised portion of the internal cavity wall, the third and fourth acoustic liners each being annular and at least partially non-metallic; and dissipating noise emanating from the working fluid as the working fluid traverses the third and fourth acoustic liners.

* * * * *